United States Patent [19]

Nelson et al.

[11] 4,416,338

[45] Nov. 22, 1983

[54] CONTROL MECHANISM FOR A PNEUMATIC TOOL

[75] Inventors: James W. Nelson, Union Grove; Raymond R. Zuzinec; Michael L. Foster, both of Kenosha, all of Wis.

[73] Assignee: Snap-on Tools Corporation, Kenosha, Wis.

[21] Appl. No.: 277,194

[22] Filed: Jun. 25, 1981

[51] Int. Cl.[3] ..... B25D 17/00

[52] U.S. Cl. ..... 173/134; 173/169; 251/297; 251/205; 251/340; 29/275

[58] Field of Search ..... 173/134, 135, 138, 169; 91/299, 317, 448; 251/205, 297, 340; 29/275

[56] References Cited

U.S. PATENT DOCUMENTS

| | | | |
|---|---|---|---|
| 1,993,501 | 3/1935 | Curtis | 173/135 X |
| 2,055,497 | 9/1936 | Hultgurst | 173/134 X |
| 2,334,403 | 11/1943 | Forss | 173/134 X |
| 2,672,129 | 3/1954 | Fischer | 173/169 X |
| 2,971,742 | 2/1961 | Fausek et al. | 251/340 |
| 3,083,944 | 4/1963 | Doeden | 251/297 X |
| 3,094,901 | 6/1963 | Wardel et al. | 173/169 X |
| 3,223,181 | 12/1965 | Price | 173/134 X |

*Primary Examiner*—Frederick R. Schmidt
*Assistant Examiner*—Robert P. Olszewski
*Attorney, Agent, or Firm*—Dithmar, Stotland, Stratman & Levy

[57] ABSTRACT

Control mechanism for a pneumatic hand tool which provides improved performance, speed regulation and control of the tool in air pressure ranges up to at least 116 pounds per square inch gauge (psig). A pneumatic hand tool embodying subject control mechanism includes a cylinder having an implement, such as a chisel, secured thereto and a reciprocating piston in the cylinder, the piston adapted to be driven by pressurized air into impact engagement with the front head of the cylinder, and returned to the rear cylinder end without impact. The control mechanism comprises an adjustable control valve which meters the volume of incoming pressurized air to that amount which produces desired tool operation, and an improved ball valve between the control valve and the cylinder. The control valve includes a radially movable spring-biased valve pin which cooperates with a valve seat, and a rotatable control ring in effective relation with the valve pin. The control ring has an internal spiral cam surface extending through about 90° adapted to move the valve pin from a radially outward fully opened position to a radially inward closed position where the valve pin firmly engages the valve seat. Intermediate settings of the control ring provide intermediate valve actions. The internal cam surface has a scallop configuration providing discrete valve pin detent positions between closed and fully opened positions.

7 Claims, 8 Drawing Figures

CONTROL MECHANISM FOR A PNEUMATIC TOOL

This invention relates to a pneumatic tool, and more particularly to control mechanism therefor which enables the tool to be used for a wide variety of jobs, and with air having a wide range of air pressures.

While the control mechanism of the invention may be used in pneumatic tools of various kinds, the mechanism as illustrated and described herein is embodied in a pneumatic hand tool primarily used for the purpose of scraping and removing stuck gasket material from parts of engines, pumps, or the like. A pneumatic gasket scraper of this type is disclosed in the copending U.S. patent application entitled "Method of Removing Stuck Gaskets and Pneumatic Impact Tool Therefor," Ser. No. 65,984, filed Aug. 8, 1979 now abandoned.

BRIEF SUMMARY OF THE INVENTION

One object of the invention is to provide an improved control mechanism for such a tool which will enhance the performance, speed regulation and control of the tool in all pressure ranges up to at least 160 pounds per square inch gauge (psig), and even higher.

Another object is to provide control mechanism for a pneumatic tool which avoids stalling on start up, as sometimes occurs with the control mechanism shown in the aforesaid application.

Another object is to provide control mechanism having internal air passageways of sizes which limit the maximum amount of air flow, thereby allowing the tool to be used at higher air pressures than otherwise.

Still another object is to provide control mechanism wherein all components readily can be disassembled for replacement of parts and cleaning, and thereafter easily reassembled.

Another object is to provide a control mechanism wherein the component ball valve may have any angular orientation within the tool, thereby promoting ease and economy of assembly.

Still another object is to provide a simplified ball valve comprising a valve body having a ball-containing chamber, a ported end plate leading to the power cylinder of the tool and ball-engaging gasket material surrounding the end plate port.

Other objects, advantages and details of the invention will be apparent as the description proceeds, reference being made to the accompanying drawings wherein one form of the invention is shown. It will be understood that the description and drawings are illustrative only, and that the scope of the invention is to be measured by the appended claims.

DETAILED DESCRIPTION

Figure 1:
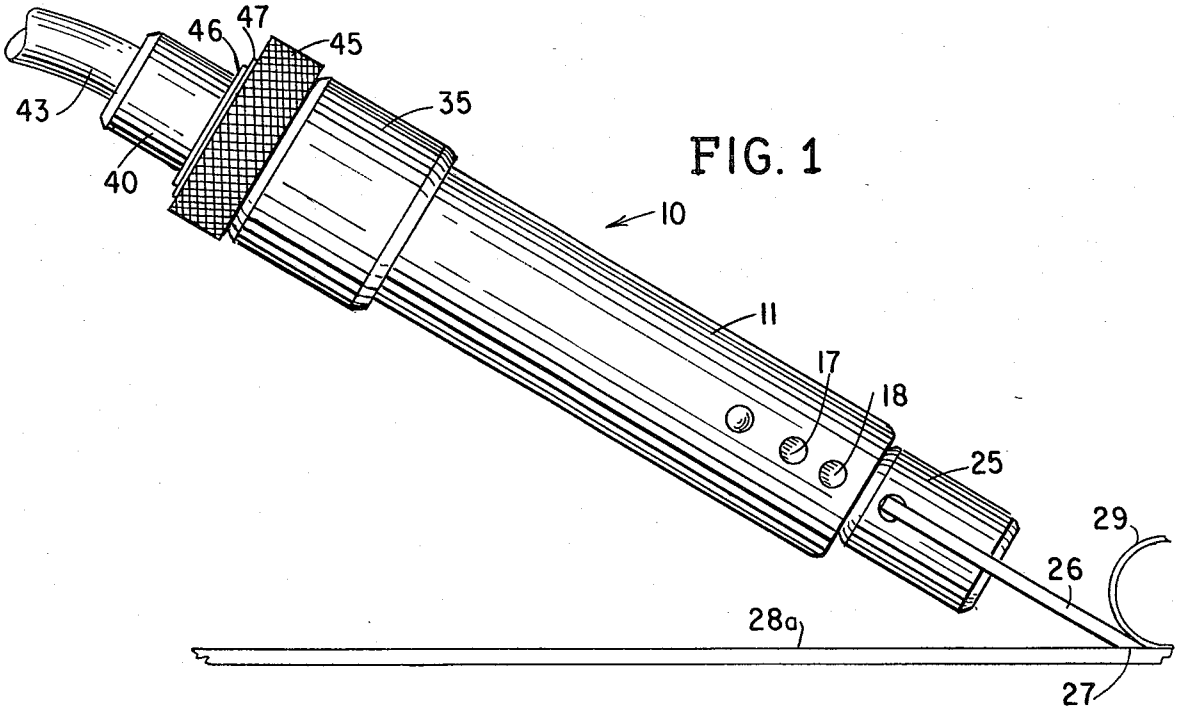
FIG. 1 is a side elevational view of a pneumatic hand tool embodying the control mechanism of the invention, the illustrated tool being shown in the act of removing gasket material from a surface.
Figure 2:
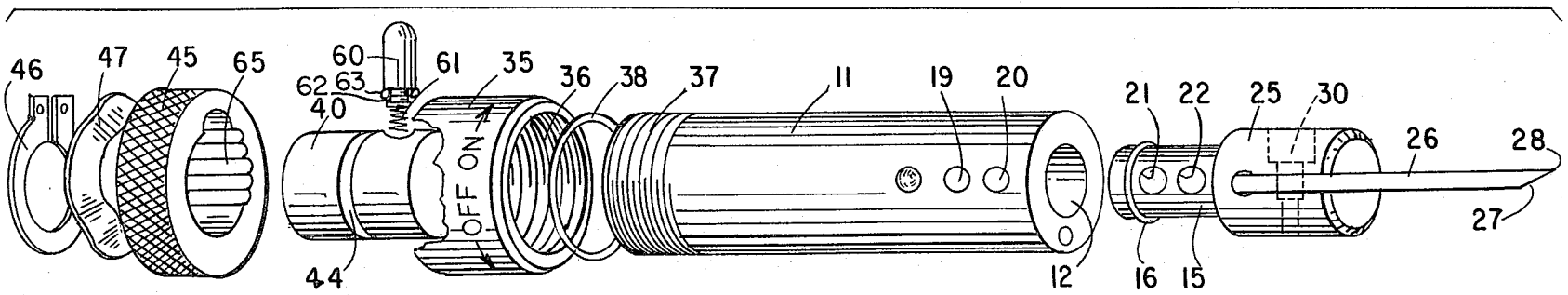
FIG. 2 is a longitudinal, perspective exploded view of the pneumatic tool shown in FIG. 1.

Referring to FIGS. 1 and 2, the control mechanism of the invention is embodied in a pneumatic hand tool generally designated 10. The illustrated tool 10 first will be described briefly.

Tool 10 includes an elongated cylindrical housing 11 having an axial opening 12 (FIG. 2) extending from end to end. An intermediate length of the axial opening 12 constitutes the power cylinder of pneumatic tool 10.

The front end of opening 12 is closed by impact head or anvil 15 (FIG. 2) which is sealed therein by suitable resilient gasket material such as an O-ring 16, also shown in FIG. 2. Anvil 15 is secured to cylindrical housing 11 by means of a pair of slit fasteners or roll pins 17 and 18 (FIG. 1) extending through transverse openings 19 and 20 (FIG. 2) in cylindrical housing 11 and transverse openings 21 and 22 (FIG. 2) in anvil 15.

As will be seen presently, a piston reciprocates back and forth within the cylinder portion of opening 12 and delivers impacts to anvil 15 which are communicated to the implement holder and implement next to be described.

An implement holder 25, as shown, is integral with cylinder head or anvil 15 and thus able to receive directly the impacts delivered by the piston to the anvil 15. Implement holder 25 is bifurcated to receive snugly a blade 26 which as shown has the general shape of a chisel, that is, the free end has an inclined surface 27 leading to a sharp edge 28. As shown in FIG. 1, inclined surface 27 is adapted to be moved along a work surface 28*a* and peel therefrom a stuck gasket 29 in response to the successive impacts delivered by the piston to anvil 15.

A transverse fastener 30 removably secures implement 26 in holder 25.

Completing the description of the illustrated pneumatic hand tool 10, a control body 35 is mounted securely on the rear end of cylindrical housing 11 as by internal threads 36 (FIG. 2) and external threads 37 on the respective members 35 and 11. A suitable gasket such as O-ring 38 insures an airtight seal between control body 35 and cylindrical housing 11.

Figure 3:
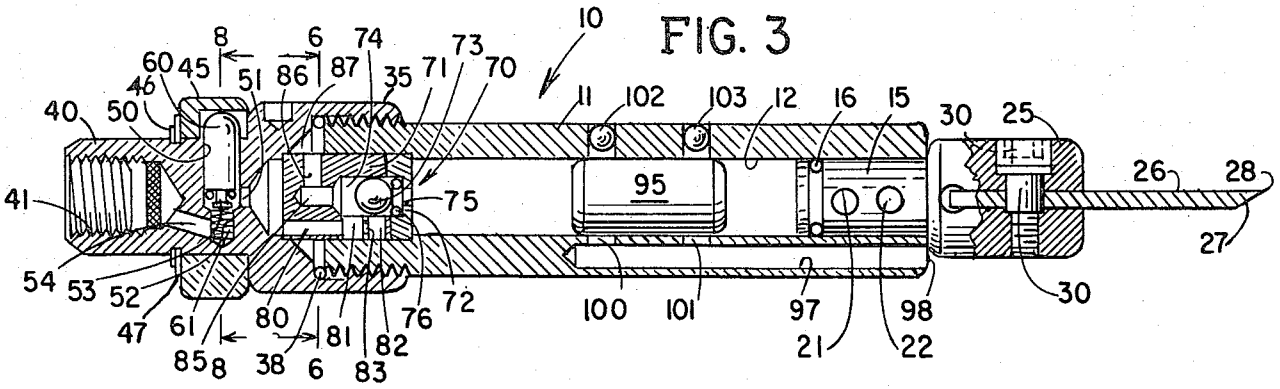
FIG. 3 is a longitudinal sectional view of the pneumatic tool of FIGS. 1 and 2 showing details of the invention.

Control body 35 has a reduced rearward extension 40 which, as shown in FIG. 3, has an internally threaded axial opening 41. An externally threaded coupling member (not shown) at the end of an air supply hose 43 is adapted to connect within opening 41 in rear extension 40 of control body 35. As best shown in FIG. 2, rearward extension 40 has an external annular groove 44 to be mentioned later.

A knurled control ring 45 is mounted rotatably on reduced rear extension 40 of control body 35, as shown in FIG. 1. Ring 45 is held in position by means of a split washer 46 received within annular groove 44 (FIG. 2) and a spring washer 47 desirably is used between split washer 46 and control ring 45 to provide frictional resistance to the rotation of ring 45.

While some of the components of the control mechanism of the invention have been mentioned generally above, these components now will be described in greater detail, together with the other components involved in the control mechanism.

Figure 8:
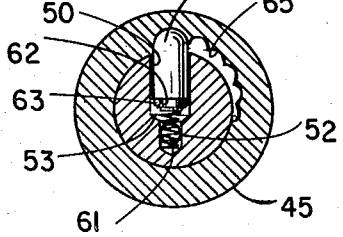
FIG. 8 is a sectional view on line 8—8 of FIG. 3.

Referring to FIGS. 2, 3 and 8, attention is directed to extension 40 of control body 35, particularly that portion of extension 40 underlying knurled control ring 45. Threaded opening 41 of extension 40 terminates short of the portion under control ring 45. The portion of extension 40 under ring 45 has a transverse or radially extending opening 50, best shown in FIG. 8, which intersects one exterior surface of extension 40 and terminates short of the opposite exterior. Opening 50 is intersected by a reduced axial opening 51 leading away from extension 40 toward cylindrical housing 11. Radial opening 50 beyond the intersection with axial opening 51 is of reduced diameter, as shown in FIGS. 3 and 8, the reduced diameter length being designated 52. A tapered shoulder caused by the drill point in forming larger opening 50 constitutes a valve seat 53, as will be seen.

A passageway 54 of comparatively small diameter extends from the inner end of threaded opening 41 of extension 40 to an intersection with the reduced diameter portion 52 of transverse opening 50. Thus, air from hose 43 is in communication with the interior of control body 35 through passageway 54, opening 52 and opening 51, valve seat 53 being located between openings 52 and 51.

A valve pin 60 (FIGS. 2, 3 and 8) slides freely in transverse or radial opening 50 of extension 40, and is biased outwardly by means of a spring 61 seated in reduced opening 52. The inner end 62 of pin 60 is reduced in diameter (FIG. 8), and an O-ring 63 surrounds the reduced diameter end 62. O-ring 63, as will be seen, cooperates with valve seat 53.

As will be understood from FIGS. 3 and 8, when valve pin 60 is moved inwardly so O-ring 63 engages valve seat 53 firmly, the valve, hereinafter called the control valve, is closed, and the tool will not operate regardless of the air pressure in hose 43.

When valve pin 60 is permitted to move outwardly so that the larger diameter portion thereof clears axial opening 51, the control valve is fully open, permitting maximum tool action in terms of frequency and impact magnitude permitted by the sizes of the passageways already mentioned, as well as sizes of passageways mentioned later. Compression spring 61, of course, moves valve pin 60 outwardly, as permitted by the rotational position of control ring 45 and a cam surface therein.

Referring to FIGS. 2 and 8, a portion of the inner periphery of control ring 45 is a cam surface 65. As shown, surface 65 extends axially from one face of control ring 45 to a termination short of the opposite face. The arcuate extent of cam surface 65 as shown is about 90°. The average radius of cam surface 65 varies from a minimum to a maximum more or less uniformly, as shown in FIG. 8. The outer end of valve pin 60, of course, engages cam surface 65.

As will be understood, the rotational position of control ring 45 determines the radial or outward position of valve pin 60. In the ring position shown in FIG. 8, valve pin 60 is so located radially that the control valve is fully open. Rotation of control ring 45 in the counterclockwise direction, as viewed in FIG. 8, through the about 90° of cam surface extent moves valve pin 60 to the extreme radially inward position and causes firm engagement between O-ring 63 and valve seat 53, thus closing the control valve. Positions of ring 45 intermediate the two extremes causes air flow through the control valve at intermediate volumes, as will be understood.

Cam surface 65 has a scallop cam configuration, as shown in FIGS. 2 and 8. The arcuate shape of each scallop conforms generally to the arcuate shape of the cooperating end of valve pin 60, to provide a series of stops for control ring 45 at the various detent positions. This arrangement overcomes any tendency on the part of control ring 45 to rotate in response to air pressure applied to valve pin 60.

Another component of the control mechanism of the invention is an improved ball valve generally designated 70 in FIGS. 3–6. Ball valve 70 is located in cylindrical housing 11 at the rear end thereof opposite to and spaced from the front cylinder head or anvil 15 previously described. As best shown in FIG. 3, ball valve 70 is in position to receive pressurized air from axial opening 51 of the control valve.

Ball valve 70 includes a valve body 71, an end plate 72 and a ball 73 which reciprocates within a chamber 74 in body 71. End plate 72 has an axial opening 75 which forms a passageway between chamber 74 of valve body 71 and power cylinder 12 of the tool. Resilient material such as an O-ring 76 surrounds axial opening 75 in end plate 72 and constitutes a seat for ball 73 when the latter is at the right-hand end of chamber 74. When ball 73 is seated on O-ring 76, air, of course, is prevented from reaching cylinder 12. End plate 72 and O-ring 76 cooperate to insure proper valve action even though there be a misalignment between valve body 71 and the end plate 72. The remaining features of ball valve 70 will be described briefly, although they are more or less conventional.

Air from outlet opening 51 of the control valve enters ball valve 70 through off center longitudinal passageway 80 in valve body 71. Passageway 80, which is sized to limit air flow to a desired maximum, intersects a pair of longitudinally spaced transverse ports 81 and 82 which lead to ball-containing chamber 74. Ports 81 and 82 communicate with each other through a port 83 in the partition between them.

A short reduced passageway 85 extends rearwardly from chamber 74 within valve body 71, and intersects with a transverse passageway 86 leading to an annular space 87 in control body 35. This space is defined generally by a portion of ball valve body 71, control body 35 and the end of cylindrical housing 11.

As previously mentioned, control body 35 is secured to cylindrical housing 11 by means of threads 36 and 37 (FIG. 2), sealing material such as an O-ring 38 being disposed between the two members.

Figure 4:
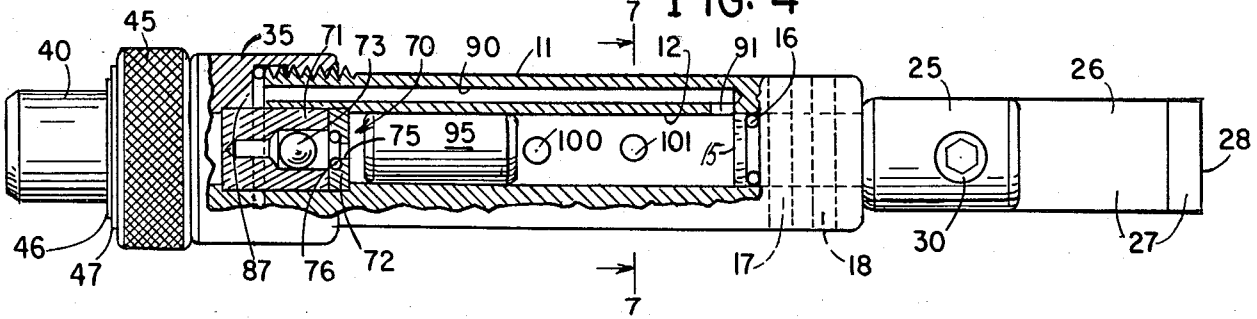
FIG. 4 is a top plan view, partly in section, of the tool shown in FIG. 3, the section in FIG. 4 being taken on a plane 90° away from the section plane of FIG. 3.

Referring to FIG. 4, cylindrical housing 11 has a longitudinal passageway 90 for piston return air, passageway 90 at its rear end being in communication with annular space 87 in control body 35. Passageway 90 terminates short of the front end of housing 11, and intersects a transverse port 91 which in turn communicates with the cylinder portion of opening 12 adjacent front head or anvil 15. At the proper time in the tool cycle, piston return air travels from annular space 87 through passageway 90 and port 91 to the cylinder region forwardly of reciprocating piston 95, thereby causing piston 95 to travel rearwardly within the cylinder.

Referring to FIG. 3, the lower wall (as shown in that figure) of cylindrical housing 11 has a longitudinal passageway 97 for exhaust air, the passageway terminating at exit port 98 which is directed forwardly of tool 10.

The location of exit port 98 is such that exhaust air escaping therefrom tends to blow away debris scraped from the work surface by implement 26.

Exhaust passageway 97 communicates with the interior of cylinder 12, and as shown, two transverse ports 100 and 101 are provided for this purpose. These ports are drilled in housing 11 through the opposite housing wall, and the unwanted openings in this wall subsequently are sealed by balls 102 and 103.

Figure 5:
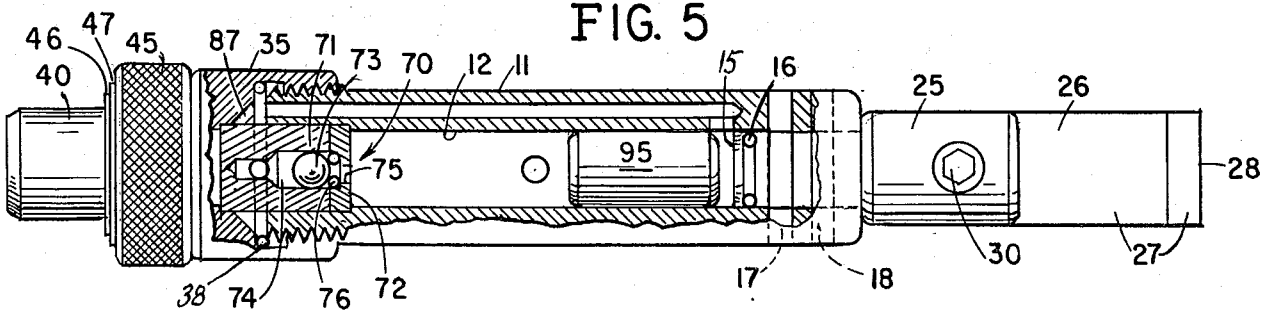
FIG. 5 is a top plan view, partly in section, generally like FIG. 4, except that the ball of the ball valve and the piston both are in alternative positions compared with the positions thereof in FIG. 4.
Figure 6:
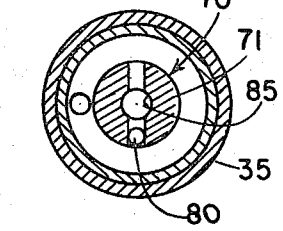
FIG. 6 is a sectional view on line 6—6 of FIG. 3.
Figure 7:
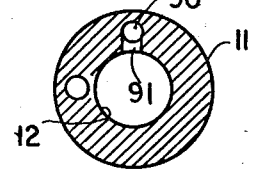
FIG. 7 is a sectional view on line 7—7 of FIG. 4.

When ball 73 of ball valve 70 is in the right-hand position shown in FIGS. 3 and 5, the ball is seated on O-ring 76, and air is prevented from entering the cylinder from the rear. Rather, air from the control valve and port 81 passes to the rear of ball 73 and through passages 85 and 86 to annular chamber 87. Air under pressure in chamber 87 travels through passageway 90 and port 91 to return the piston 95 to its rear position. Some air from the cylinder escapes through exhaust ports 100 and 101 to exhaust passageway 97 and exhaust port 98.

As piston 95 approaches end plate 72 of ball valve 70, the air at the left of the approaching piston causes ball 73 of ball valve 70 to shift to its rear position, as shown in FIG. 4.

In the rear position, ball 73 blocks the piston return air passage 90, and permits the pressurized air from the control valve to enter the ball chamber forwardly of the ball through port 82. At this time in the cycle, air forwardly of ball 73 enters cylinder 12 and drives piston forcibly into impact engagement with anvil 15, thereby delivering an impact to implement 26 and to the "work" it is performing. During forward travel of piston 95, air in the forward portion of cylinder 12 escapes through exhaust ports 100 and 101, and also back through port 91, passageway 90 to chamber 87, which at this time is at low pressure.

From the above description, it is believed that the construction and advantages of the control mechanism of the invention will be readily apparent to those skilled in the art, particularly when considered in relation to the aforesaid pending application. Various changes in detail may be made without departing from the spirit or losing the advantages of the invention.

Having thus described the invention, what is claimed as new and desired to secure by Letters Patent is:

1. In a pneumatic tool including a cylinder having a rear end and a front end, means for securing an implement to the cylinder at the front end, a piston in the cylinder adapted to be driven alternately forwardly and rearwardly by pressurized air, and control mechanism comprising a control body secured to the rear end of the cylinder, said body having an inlet for pressurized air and an outlet for regulated air directed toward the front end and a transverse opening communicating with said inlet and said outlet, a valve pin in said transverse opening and movable to a selected one of a plurality of positions between first and second extremes, the amount of air from said inlet to said outlet being a minimum in the first extreme and a maximum in the second extreme, means biasing said valve pin to one of the extremes, and control means for placing said valve pin in a selected one of the positions, said control means including a plurality of detent means engageable with said valve pin for retaining said control means in a condition corresponding to the selected position of said valve means.

2. In the pneumatic tool of claim 1, wherein said transverse opening is radially extending.

3. In the pneumatic tool of claim 1, wherein said transverse opening extends radially, said valve pin being in its most radially outward position when the amount of air from said inlet to said outlet is a maximum and being in its most radially inward position when the amount of air from said inlet to said outlet is a minimum.

4. In the pneumatic tool of claim 1, wherein said biasing means biases said valve pin to the second extreme.

5. In the pneumatic tool of claim 1, wherein substantially no air passes from said inlet to said outlet in the first extreme of said valve pin.

6. In the pneumatic tool of claim 1, wherein said control means is an annular control knob rotatably mounted on said control body, said control knob having an internal surface defining said detent means.

7. In the pneumatic tool of claim 6, wherein said internal surface has a scallop configuration providing a plurality of discrete valve pin detents.

* * * * *